United States Patent [19]

Sekulich

[11] 3,996,930

[45] Dec. 14, 1976

[54] SELF-CONTAINED GYNECOLOGIC STIMULATOR

[76] Inventor: Mark W. Sekulich, 252 Ximeno, Long Beach, Calif. 90803

[22] Filed: Oct. 2, 1975

[21] Appl. No.: 618,902

[52] U.S. Cl. ..... 128/67; 128/79

[51] Int. Cl.[2] ..... A61H 7/00; A61H 19/00

[58] Field of Search ..... 128/24 R, 61, 79, 57, 128/67, 128, 62 R, 401, 36

[56] References Cited

UNITED STATES PATENTS

| | | | |
|---|---|---|---|
| 734,213 | 7/1903 | Barnes | 128/401 |
| 2,478,786 | 8/1949 | Smallen | 128/67 |
| 3,504,665 | 4/1970 | Bakunin et al. | 128/36 |

FOREIGN PATENTS OR APPLICATIONS

| | | | |
|---|---|---|---|
| 496,086 | 9/1930 | Germany | 128/57 |
| 2,041,572 | 2/1972 | Germany | 128/57 |

*Primary Examiner*—Lawrence W. Trapp

*Attorney, Agent, or Firm*—Fulwider, Patton, Rieber, Lee & Utecht

[57] ABSTRACT

A gynecologic stimulator formed by a resilient V-shaped member for receipt in a wearer's vulvovaginal gland and having the opposite legs thereof defining anterior and posterior legs. The anterior leg is formed on its inner, or posterior, side with an elongated trough for receipt of the clitoris and has a longitudinally extending central rib formed therein with transverse rings spaced therealong.

8 Claims, 4 Drawing Figures

SELF-CONTAINED GYNECOLOGIC STIMULATOR

BACKGROUND OF THE INVENTION

1. Field of the Invention

The present invention relates generally to gynecological devices for stimulating the erotic areas of the clitoris and vagina to induce sexual stimulation and satisfaction.

2. Description of the Prior Art:

Many different types of stimulator devices have been proposed for both manual vibratory stimulation before and during intercourse in effort to assure the female partner's enjoyment thereof and to induce sexual climax concurrent with the male partner. However, many such prior art devices are cumbersome to carry about and inconvenient to use, as well as having an initial negative psychological effect on the female partner. Further, most of such devices are not self-contained within the vagina during use.

SUMMARY OF THE INVENTION

The gynecologic stimulator of the present invention is characterized by an elongated resilient member insertable in a vagina to assume a general V-shape formed with opposed anterior and posterior legs. The anterior leg is formed on its interior side with an elongated concave trench for receipt of the clitoris upon insertion.

The objects and advantages of the present invention will become apparent from a consideration of the following detailed description when taken in conjunction with the accompanying drawings.

DESCRIPTION OF THE PREFERRED EMBODIMENT

Figure 1:
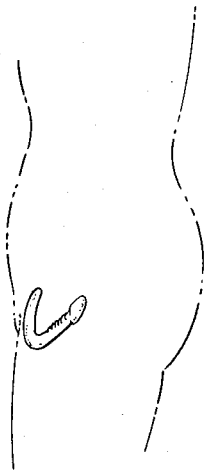
FIG. 1 is a side elevational view of a female having the sexual stimulator of the present invention in position.
Figure 2:
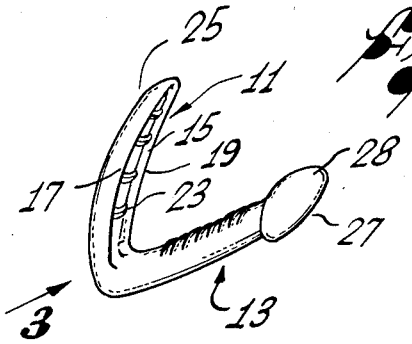
FIG. 2 is a perspective view, in enlarged scale, of the stimulator shown in FIG. 1.
Figure 3:
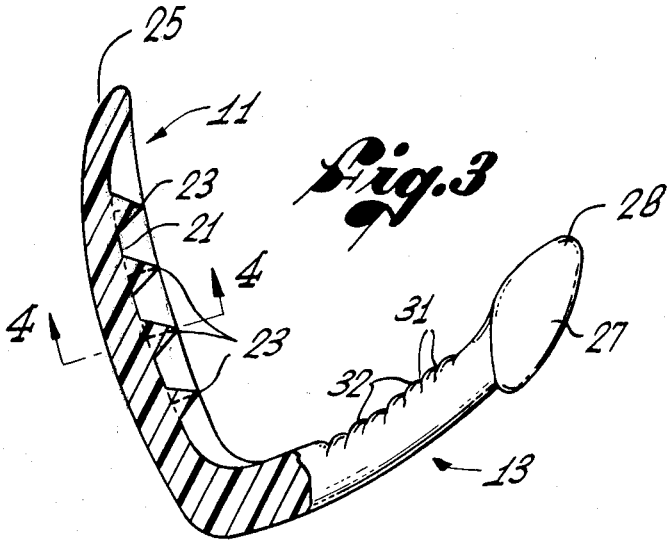
FIG. 3 is a side elevational view, in enlarged scale, and partially broken away, of the gynecologic stimulator shown in FIG. 2.

Referring to FIGS. 2 and 3, the gynecologic stimulator of the present invention is in the form of a resilient member forming a general V-shape with the opposite extremities thereof defining anterior and posterior legs, generally designated 11 and 13, respectively. The member itself is generally circular-in-cross section with the anterior leg 11 being formed with a longitudinal, inwardly or posteriorly facing trough 15 projecting substantially the full length thereof for normal receipt therein of the clitoris. Consequently, the stimulator may be inserted in the vagina with the posterior leg 13 received generally in the area of the fossa navicularis and the anterior leg 11 received in the area of the prepuce of clitora, to be held in position by its own resiliency, the clitoris itself being received in the trough 15 whereby various maneuverings of the wearer's legs will result in relative shifting between the clitoris and the anterior leg 11 to cause manipulation and massaging of the clitoris and consequent excitation and stimulation.

The gynecologic stimulator of the present invention is intended for a full grown female adult and is approximately 5/16 inch in diameter with each leg 11 and 13 thereof being approximately 3 inches in length. The anterior leg 11 is formed longitudinally on its inside with the trough 15 which is U-shaped-in-cross section and approximately ¼ inch wide at its longitudinal opening and being formed on its sides with resilient side walls 17 and 19.

Figure 4:
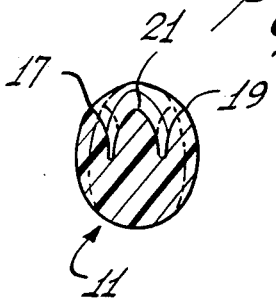
FIG. 4 is a transverse sectional view, in enlarged scale, taken along the line 4—4 of FIG. 3.

Referring to FIGS. 2 and 4, the trough 15 is formed centrally with a longitudinally extending rib 21 which has massage rings 23 spaced about every ½ inch therealong.

Referring to FIG. 3, it will be appreciated that the overall exterior of the stimulator, when in its relaxed position, is somewhat in the shape of a boomerang with the opposite extremities thereof being tapered inwardly slightly towards one another to form nesting curves 25 and 27, respectively, for comfort during use. The posterior leg 13 is formed at its extremity with a bulbous bearing head, generally designated 28, the exterior surface of which forms the nesting curve 27. The interior side of the posterior leg 13 is formed with transversely projecting flex grooves 31 defining therebetween transverse rings 32 which induce flexing of the leg 13, as well as enhance stimulation during use.

In operation, the gynecologic stimulator of the present invention is generally utilized by the female partner in order to provide pre-intercourse stimulation, readying her for full enjoyment. Consequently, the stimulator, being self-contained, may be inserted a significant time period prior to the actual anticipated act and is easily inserted by opening the vulvovaginal gland and inserting the posterior leg 13 thereinto and nesting the curved surface 27 of the head 28 posteriorly against the fourchette while the anterior leg 11 has its extremity bent inwardly towards the posterior leg 13 to receive the clitoris within the trough 15 and to receive the anterior leg curved surface 25 in the prepuce.

The stimulator is then shifted about until comfortable and may be held in place by a pair of panties. It will be appreciated that as long as the wearer's legs are in the normal side-by-side position, as in walking, standing or sitting with the knees forward, the side walls 17 and 19 (FIG. 4) will be flexed inwardly towards one another to the broken line position shown in FIG. 4, thereby serving to maintain the exciter rib 21 spaced from the clitoris and consequently enabling the wearer to move about without stimulating the clitoris.

However, when the wearer's legs are separated, relieving pressure from the sides of the anterior leg 11, the side walls 17 and 19 of the trough 15 will assume their relaxed position opening such trough and exposing the exciter rib 21 to the clitoris, thereby resulting in any further movement of the wearer's leg causing relative movement between the clitoris and the rib, thus stimulating the clitoris. It will be appreciated that such stimulation is enhanced by exaggerated movements which cause flexing and unflexing of the stimulator and consequent shifting of the massage rings 23 back and forth relative to the clitoris, thereby enhancing stimulation. Thus, the wearer can control the amount of stimulation desired by merely increasing or lessening movement and consequent increase or decrease in relative movement between such stimulator and the clitoris.

When it is desirable to remove the stimulator from the vagina, the wearer can merely grasp the anterior leg 11 and bend it downwardly slightly to thus free it from the prepuce and then withdraw the entire stimulator for cleaning and sanitation.

From the foregoing, it will be apparent that the gynecologic stimulator of the present invention provides an economical and convenient means for subtly inducing stimulation of the wearer without the necessity of large cumbersome devices which are inconvenient to use. Further, such stimulator being relatively small in size, quickly warms to the body temperature and has little negative psychological effect on the wearer upon initial introduction thereto.

Various modifications of the present invention may be made with regard to the foregoing detailed description without departing from the spirit of the invention.

We claim:

1. A self-contained gynecologic stimulator comprising:

a resilient elongated member for receipt in a vagina to form a general V-shape with one leg thereof forming a posterior leg and the other leg forming an anterior leg, said anterior leg being formed on its interior side with an elongated concave trough for receipt of the clitoris.

2. A self-contained gynecologic stimulator as set forth in claim 1 wherein:

said trough is formed with a central longitudinally extending exciter rib.

3. A gynecologic stimulator as set forth in claim 1 wherein:

said trough is formed with a plurality of longitudinally spaced apart massage rings.

4. A gynecologic stimulator as set forth in claim 1 wherein:

said anterior leg is formed with side walls collapsible inwardly toward the center of said trough.

5. A gynecologic stimulator as set forth in claim 1 wherein:

said posterior leg is formed along its inner wall with a plurality of transversely extending flex ribs.

6. A gynecologic stimulator as set forth in claim 2 wherein:

said trough is formed with a plurality of longitudinally spaced apart massage rings.

7. A gynecologic stimulator as set forth in claim 2 wherein:

said anterior leg is formed with side walls collapsible inwardly toward the center of said trough.

8. A gynecologic stimulator as set forth in claim 2 wherein:

said posterior leg is formed along its inner wall with a plurality of transversely extending flex ribs.

* * * * *